United States Patent [19]

Jarvis et al.

[11] Patent Number: 4,544,296

[45] Date of Patent: Oct. 1, 1985

[54] DISPOSABLE PROPEL-REPEL PENCIL

[75] Inventors: William A. Jarvis, Dunwoody, Ga.; John Kirby, S. Hamilton, Mass.; Alan J. Lane, Lexington, Mass.; John P. Pokorski, Chelmsford, Mass.; Wilbur L. Sheffield, Needham, Mass.

[73] Assignee: Scripto, Inc., Atlanta, Ga.

[21] Appl. No.: 200,786

[22] Filed: Oct. 27, 1980

Related U.S. Application Data

[63] Continuation of Ser. No. 947,580, Oct. 2, 1978, abandoned.

[51] Int. Cl.[4] ..... B43K 21/08

[52] U.S. Cl. ..... 401/73; 401/68; 401/75

[58] Field of Search ..... 401/68, 73, 74, 75, 401/76, 77, 78, 80, 86

[56] References Cited

U.S. PATENT DOCUMENTS

| | | | |
|---|---|---|---|
| 1,579,029 | 3/1926 | Rang | 401/78 |
| 1,621,990 | 3/1927 | Lippert et al. | 401/73 |
| 1,734,784 | 11/1929 | Vierling et al. | 401/68 |
| 2,203,093 | 6/1940 | Kahn | 401/68 X |
| 2,427,941 | 9/1947 | Bauer | 401/73 |
| 2,464,035 | 3/1949 | Hasselquist | 401/73 |
| 2,492,838 | 12/1949 | Brubaker | 401/73 |
| 2,624,313 | 1/1953 | Jacobsen et al. | 401/75 |

FOREIGN PATENT DOCUMENTS

| | | | |
|---|---|---|---|
| 1815535 | 12/1968 | Fed. Rep. of Germany | 401/68 |
| 244701 | 7/1926 | United Kingdom | 401/73 |
| 236280 | 12/1971 | U.S.S.R. | 401/68 |

*Primary Examiner*—Edward M. Coven

*Attorney, Agent, or Firm*—Newton, Hopkins & Ormsby

[57] ABSTRACT

A mechanical pencil is disclosed that includes a barrel with a non-circular internal bore, a helical coil member that is fitted within the bore and attached to an externally positioned driving member, and a lead positioning means or pusher member that is positioned about and threadably engaged with the coil and constrained by the non-circular bore of the barrel for sliding longitudinal movement therein. The lead positioning means or pusher member includes fins that extend through the coil turns and act as a positioning stop for the writing lead and a lead gripping means for propelling and repelling the centrally disposed writing lead upon the manual rotation of the external driving member that is attached to the coil disposed within the barrel.

14 Claims, 7 Drawing Figures

DISPOSABLE PROPEL-REPEL PENCIL

This is a continuation of application Ser. No. 947,580, filed Oct. 2, 1978, now abandoned.

BACKGROUND OF THE INVENTION

1. Field of the Invention

This invention relates generally to mechanical pencils and in particular to mechanical pencils composed of a relatively few, simple inexpensive components readily adaptable to automatic assembly specifically for sale as a disposable writing instrument.

2. Description of the Prior Art

Previous designs of mechanical pencils that employed a helical coil rotatable inside a hollow barrel have either utilized split tubes surrounding the lead, or pushers which are disposed in the interior of the coil or split tube. Such prior pushers had radially extending projections which engaged the coil or barrel. These constructions necessitated threading the pusher into the coil or split tube to the proper position at assembly and therefore required the design of relatively complex and expensive machinery to accomplish the assembly of the various components.

Other types of pusher which engaged the coil about its turns were constrained by a separate guide means positioned within the barrel of the writing instrument. Here it was necessary to physically interconnect the pusher with the guide means as well as interconnecting the pusher with the coil, all of which entailed complex and expensive structures and methods of assembly.

Examples of such prior art are disclosed in U.S. Pat. Nos. 966,712 to C. A. Smith, 1,539,468 to Cook et al., 2,866,438 to Schischkow and 3,630,628 to Roman.

Accordingly, it is the object of the present invention to provide a mechanical pencil employing relatively few components, each of which is inexpensive and readily assembled by simple machines.

More specifically, it is the object of this invention to provide a mechanical pencil of such simplicity of structure, minimum number of parts, adaptability for automatic assembly and low cost of manufacture as to permit optional discarding of the pencil after the initial lead has been consumed, thereby eliminating the necessity of the user keeping a supply of spare refill leads and undergoing the sometimes tedious process of replacing the refill leads in the pencil with the attendant possibility of lead breakage during this process. The mechanical pencil of the present invention by its simplicity and low cost of manufacture hence is competitive with other disposable writing instruments.

SUMMARY OF THE INVENTION

The present invention relates to a mechanical pencil that includes a barrel having a non-circular bore, a rotatable helical coil fitted within this bore, an external driving member attached at the rearward end of the barrel and operably connected to the coil, and a lead positioning means or pusher member interposed between the exterior convolutions of the coil and the interior bore of the barrel. The pusher is configured to engage the turns of the coil from about its exterior surface and is constrained within the non-circular bore for longitudinal sliding movement within the barrel so that rotation of the driving member that is connected to the helical coil will cause longitudinal translation of the lead positioning means within and relative to the barrel.

Stop fins on the interior portion of the pusher extend through the turns of the coil and engage the rearward end of the centrally located writing lead and serve to provide the contact to propel the lead forwardly and thereby project it from the front end of the pencil to maintain the proper lead extension for writing purposes as the lead is worn away during use.

The lead positioning means or pusher also includes gripping fins spaced forwardly from the stop fin and adapted for elastic transverse displacement to frictionally engage the writing lead so that retraction of the lead may be accomplished by reverse rotation of the coil relative to the barrel. The lead positioning means has a longitudinally extending guide rail that is disposed within a longitudinal extending channel or groove portion of the non-circular bore of the barrel to provide the means to translate the rotary movement of the coil into longitudinal movement of the lead. The lead positioning means is a separate unit positioned within the main internal bore of the barrel in captive spaced relation between an internal wall portion of the barrel and the exterior configuration of the coil and is operatively associated solely by abutting contact between said members.

DESCRIPTION OF THE ILLUSTRATIVE EMBODIMENT

Figure 4:
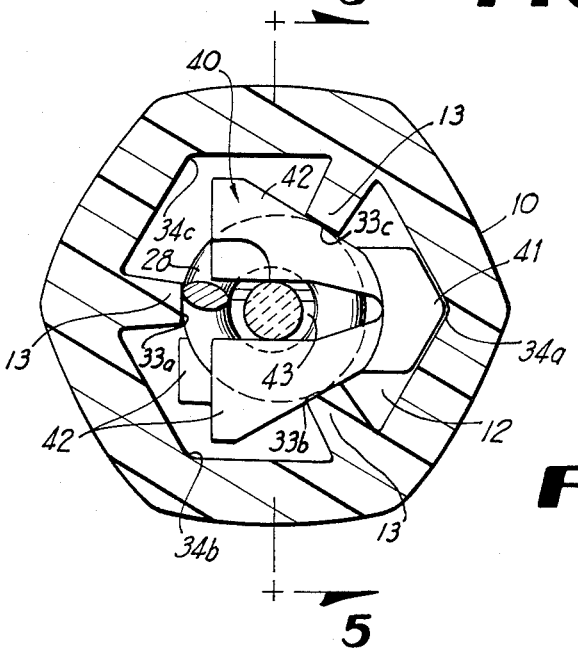
FIG. 4 is a transverse cross section of the mechanical pencil taken along lines 4—4 of FIG. 1.
Figure 5:
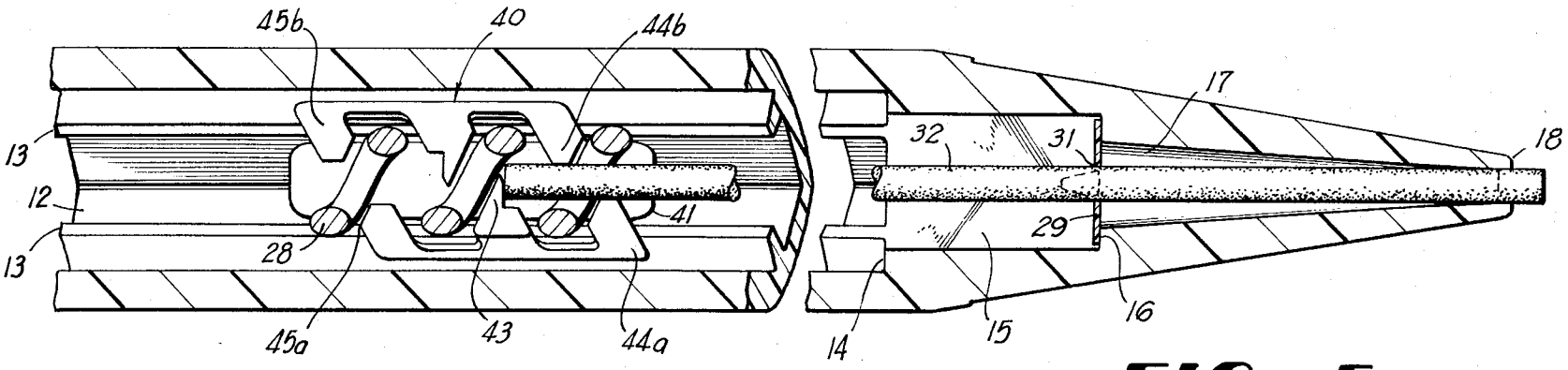
FIG. 5 is a partial, broken, longitudinal cross-sectional view of the mechanical pencil of the present invention taken along lines 5—5 of FIG. 4.
Figure 6:
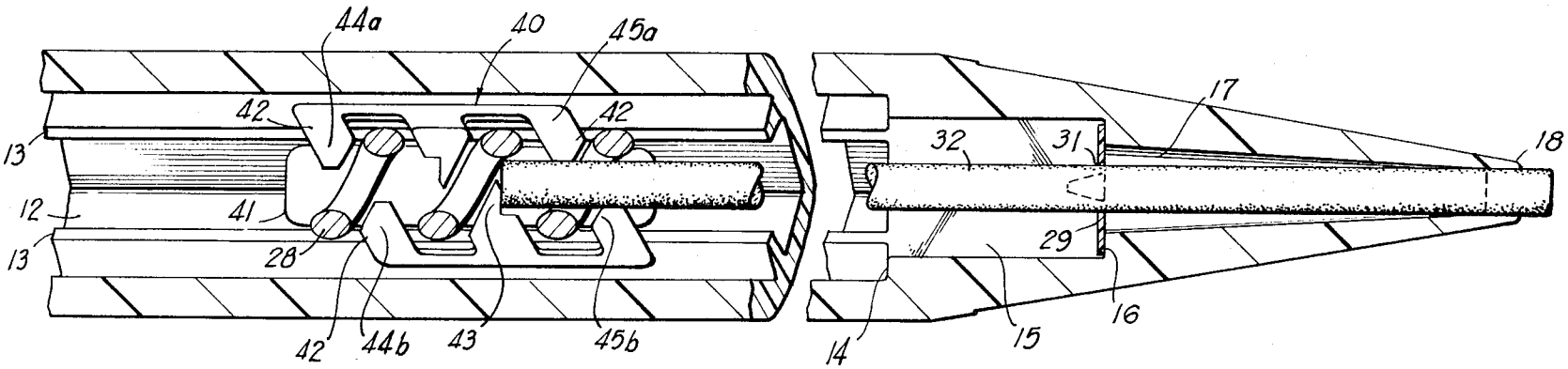
FIG. 6 is a partial, broken, longitudinal cross-sectional view of an embodiment of the mechanical pencil of the present invention similar to FIG. 5 that utilizes a larger diameter lead.

The mechanical pencil of the present invention includes an elongated hollow barrel 10, terminating in a frusto-conical tip section 11. As shown in FIGS. 4, 5 and 6, the barrel includes a main generally hexagonal bore 12 having three equally spaced inwardly extending ribs 13. The internal generally hexagonal bore 12 of barrel 10 changes at shoulder 14 to a forward generally triangular cross section 15 which terminates at shoulder 16. A forward conical bore 17 has a terminal tip 18 which is of a diameter approximately equal to the diameter of the writing lead.

Figure 1:
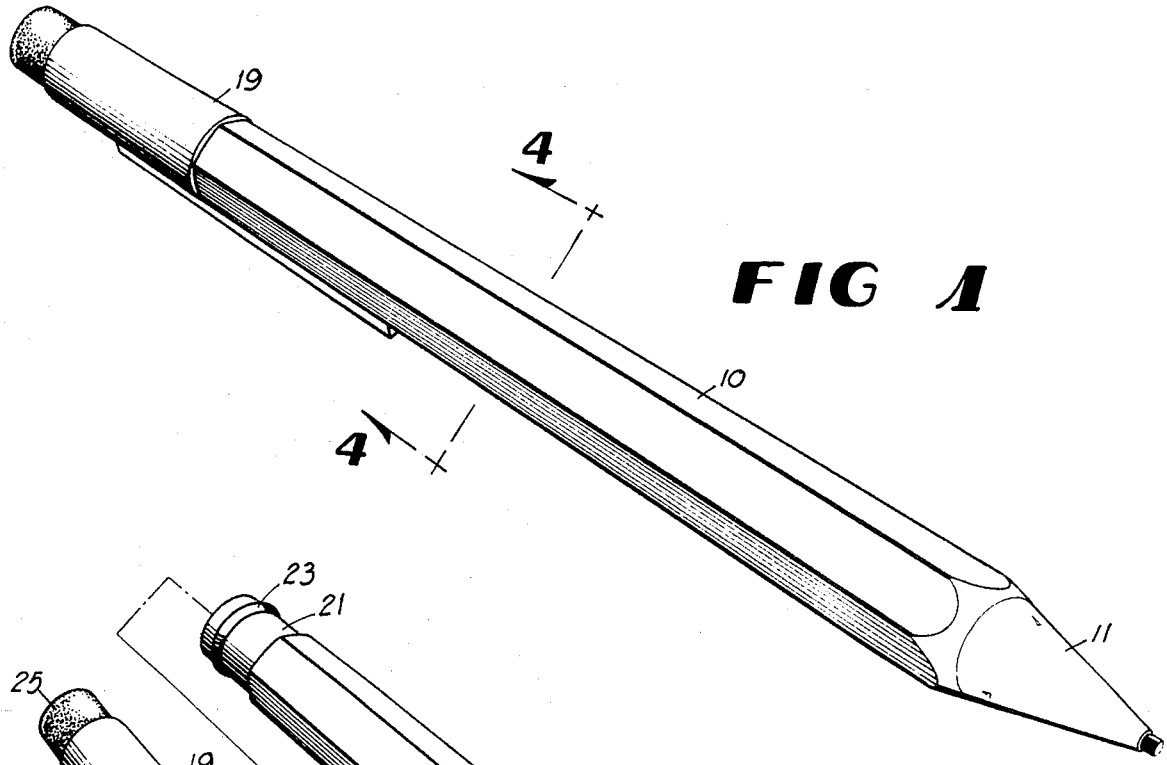
FIG. 1 is a perspective view of the mechanical pencil of the present invention.
Figure 2:
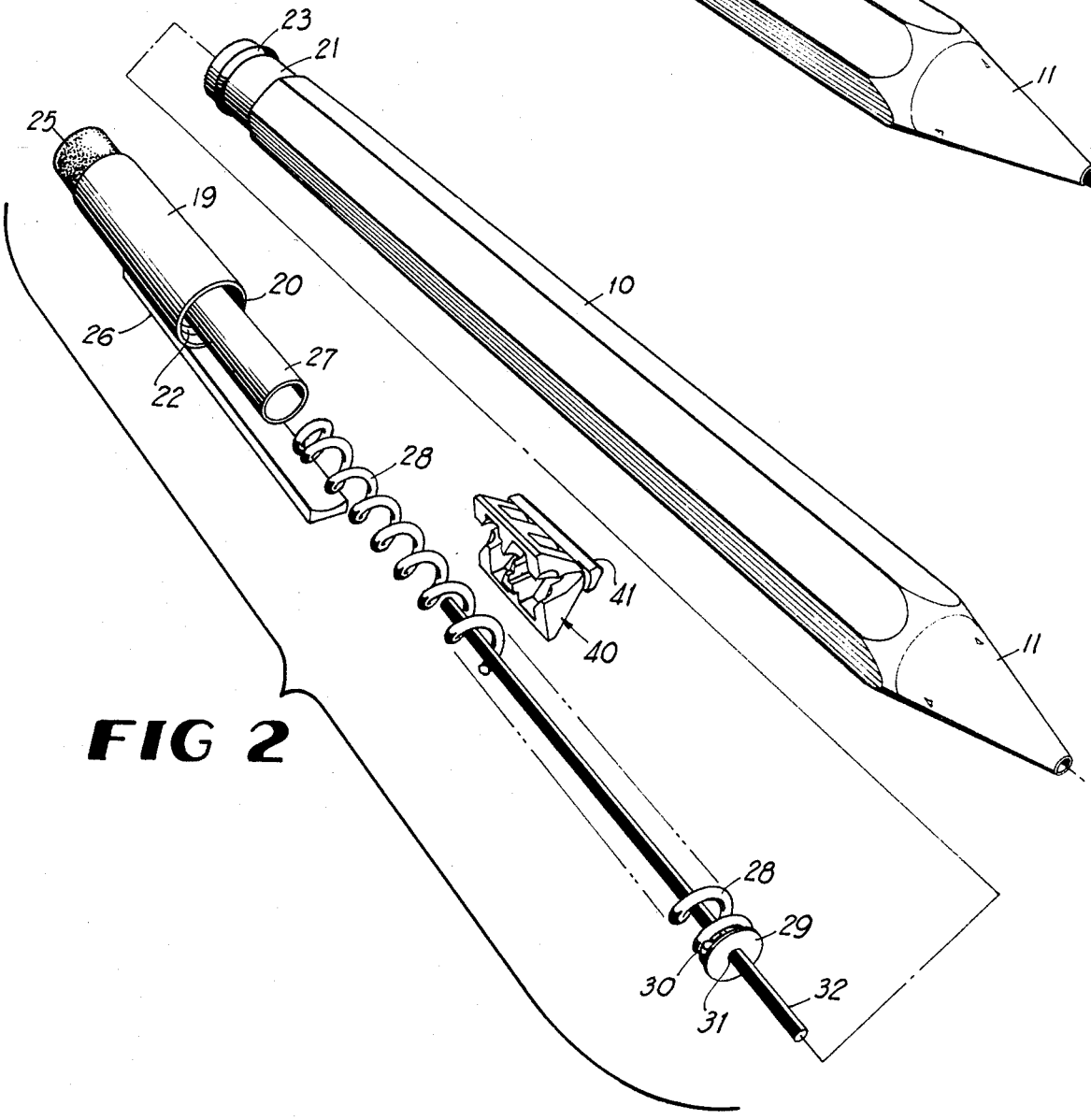
FIG. 2 is an exploded perspective view of the principal component parts of the pencil of the present invention.
Figure 7:
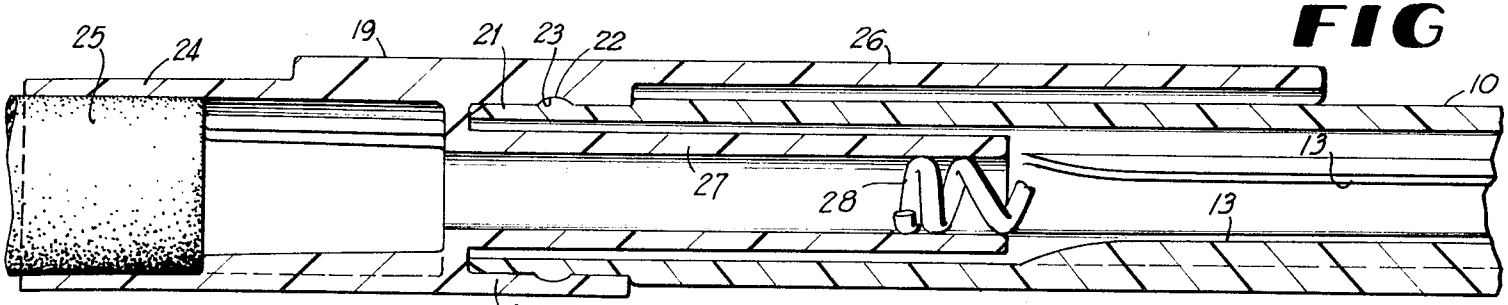
FIG. 7 is a partial, longitudinal cross section showing the drive member assembled with the rear of the barrel.

As shown in FIGS. 2 and 7, the driving member 19 is basically a tubular member consisting of an external forwardly extending sleeve portion 20 fitted over and in rotational engagement with the rearward end 21 of barrel 10. Internal circumferential groove 22 on sleeve portion 20 co-acts with external circumferential ring 23 of barrel end 21 to provide a snap fitted rotational fit between driving member 19 and barrel 10, while preventing unintentional longitudinal disengagement of these components. Rearward facing tubular portion 24 of driving member 19 is adapted to frictionally retain an eraser 25. Extending forwardly from the eraser holder section 24 exterior to and overlying the barrel is an integral clip 26. Driving member 19 has an internal tubular section 27 extending forwardly into the rear of the internal bore of barrel 10. This tubular section 27 has an internal diameter which provides a press fit to the exterior of a helical coil 28, fitted in the internal bore 12 of barrel 10 and extending forwardly to the vicinity of step 16 in the forward end of barrel 10. Interposed in the space between the forward end of coil 28 and step 16 is a thin plastic washer 29 made of "Mylar" or similar plastic material. The inside diameter 31 of washer 29 is made slightly smaller than the lead diameter to positively grip the lead 32. Should the lead become broken between washer 29 and pusher 40 washer 29 provides sufficient friction on lead 32 to prevent it from falling out of the pencil; under this circumstance the propel function of the pencil remains and only the repel function is lost.

The outside surfaces of coil 28 contact internal bore surfaces 33*a*, 33*b*, 33*c* of barrel 10 as delineated in FIG. 4.

Interposed in one of the guide channels 34*a*, 34*b*, 34*c* disposed between ribs 13 of barrel 10 is a lead positioning means or pusher member 40. Referring now to FIGS. 2 through 6, the lead positioning means or pusher member 40 has an external longitudinal rail or rib 41 adapted to fit into one of the aforementioned spaces 34. The main body of pusher 40 consists primarily of fin portions 42 extending radially inwards between the turns of coil 28. A separate centrally located stop fin 43 also extends radially inward and projects beyond center line of coil 28, to provide a stop for the rearward end of lead 32.

Figure 3:
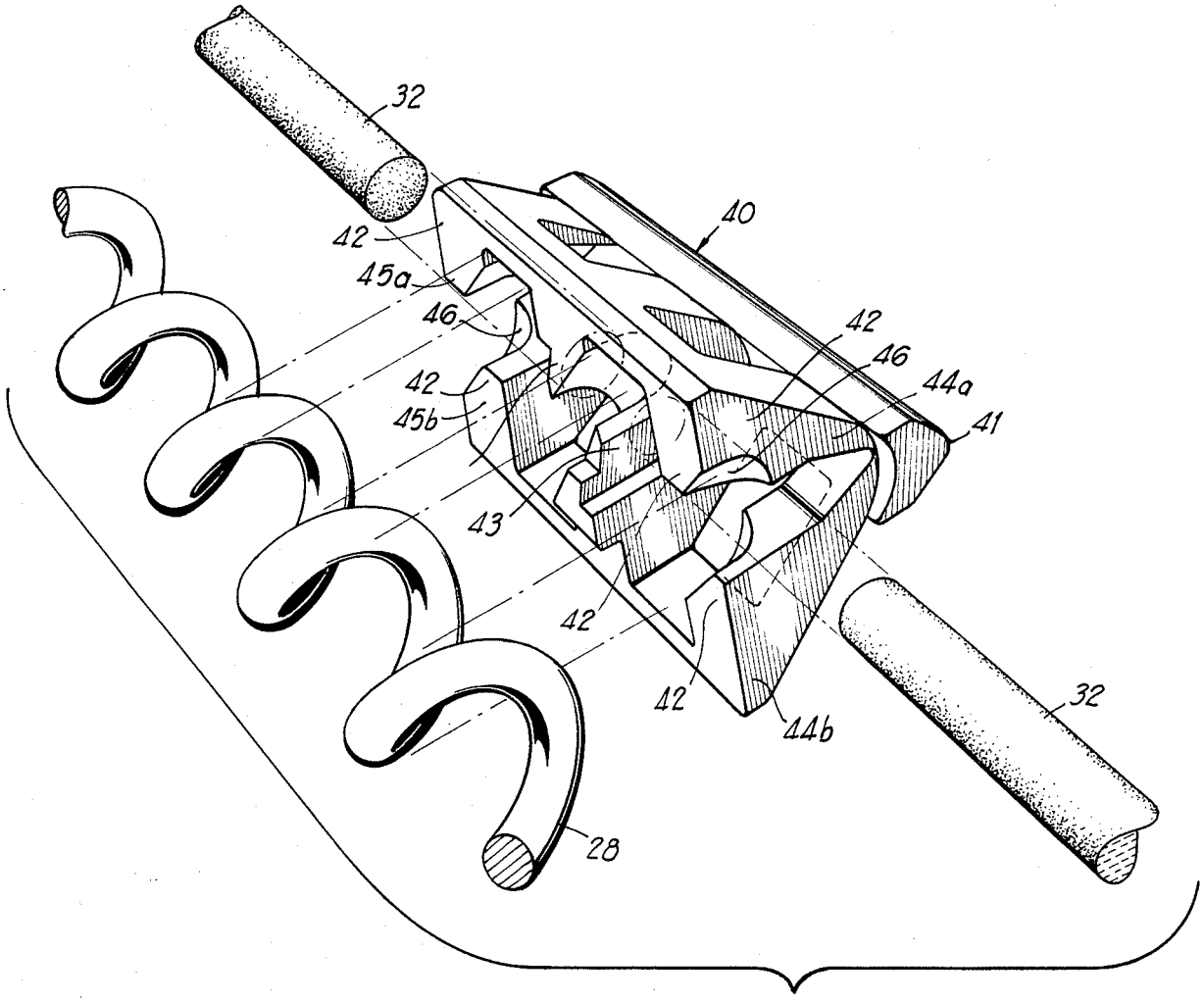
FIG. 3 is an exploded perspective view showing the lead positioning means, a section of the coil, and adaptability of opposite end of the lead positioning means to receive leads of a different size.

Referring now to FIG. 3, forwardly disposed fin 44 of the lead positioning means or pusher 40 is bifurcated into two segments 44*a* and 44*b* which are elastic and laterally yieldable. These two segments form a gripping or clutch fin which segments overlie the diameter of lead 32 and engage the lead 32 with a frictional grip to prevent rotation and longitudinal movement relative to pusher 40. The leading fin portion at each end of the pusher 40 has a lead camming face 46 for guiding the lead 32 between the gripping fin portion 44*a–b* and 45*a–b* into contact with stop fin 43.

As shown in FIG. 3, the lead positioning means 40 is symmetrical about an axis that is at right angles to the longitudinal axis and centered about the central stop fin 43. Therefore, clutch fin 44*a*–44*b* can perform the same function as clutch fin 45*a*–45*b*. Thus the lead positioning means 40 of FIG. 3 may be installed in the pencil with either end forward.

In one form as shown in FIGS. 5 and 6, clutch fins 44*a* and 44*b* are of a different spacing than their counterparts 45*a* and 45*b* at the opposite end of the pusher 40. In this instance the pusher may serve in two different types of pencils, one of a standard lead size (0.046 inches diameter) as shown in FIG. 6 and the other of a fine line size (0.036 inches diameter) as shown in FIG. 5 merely by installing the pusher in the pencil with the desired end forward to co-act with the specific lead size chosen. In this instance, of course, the forward diameter in the terminal tip 18 of barrel 10 must be of the proper diameter for the lead size chosen. Such a change can be made by a minor change in core pins of the mold for barrel 10 when the barrel is made of molded plastic.

If it is desired that only one size lead be used in a pencil of this type, then both ends of the lead positioning means 40 can have the clutch fins formed with the same spacing and thus eliminate the necessity for any end orientation means in an automatic assembly operation.

In all instances, the lead positioning means 40 is fitted to the coil externally and the stop and clutch fins fit inbetween the turns of the coil without the necessity of the lead positioning means or pusher 40 being laced into the coil or, alternatively, threaded into the coil as is required in previous mechanism designs. Thus the lead positioning means or pusher 40 is held in operating position solely by its captive spacing between the exterior surfaces of the turns of coil 28 and the interior wall surfaces of the hexagonal bore 12.

OPERATION

In operation, clockwise rotation of the driving member 19 rotates the coil 28 resulting in longitudinal movement of the lead positioning means or pusher 40, since the pusher 40 is threadedly engaged with the exterior of the coil 28 and can not rotate in respect to barrel 10 because of the guide rail or rib 41 nesting in one of the guide channels or grooves 34 of the barrel 10. Stop fin 43 of the pusher 40 thereby forces lead 32 forwardly from the terminal tip 18. Conversely, counterclockwise rotation of the driving member 19 results in retraction of the lead 32 since clutch fins 44*a* and 44*b* or 45*a* and 45*b* keep the lead 32 frictionally retained within the fin portions by virtue of the transverse yieldable elasticity thereof.

It is understood that the writing instrument of the present invention may utilize various forms of marking elements other than graphite lead which are worn away by use, such as crayons and the like. Also, the writing instrument of the present invention may be used with marking elements that do not wear away through use, such as a ball point cartridge and the like which, when used, may be selectively projected from and retracted within the barrel.

It should be understood that the aformentioned embodiments merely illustrate the principles of the invention and modifications may be made in the specific structures without departing from the spirit and scope of the invention as set forth in the following claims.

What is claimed is:

1. A writing instrument adapted to contain a marking element therein comprising a barrel having a forward and rear end and internal wall portions forming a main internal bore, a flexible spiral coil positioned within said bore and adapted for manual rotation therein, a plurality of longitudinally extending ribs positioned within said bore for laterally supporting the exterior configuration of said spiral coil and a unitary marking element positioning means operatively positioned within said bore in captive relation between an internal wall portion of said barrel and the external configuration of said coil and restrained for longitudinal movement within said bore in response to rotation of said coil, said marking element positioning means being located between two of said ribs and restrained thereby for such longitudinal movement, said marking element positioning means having forwardly and rearwardly facing portions and an integrally formed stop member positioned between said portions and adapted to engage a marking element inserted into either of said portions and to arrest the rearward movement thereof relative to said marking element positioning means, each of said forwardly and rearwardly facing portions including an integrally formed bifurcated element having elastic and laterally yieldable elements disposed within said coil and adapted to engage and frictionally grip a marking element inserted between the bifurcations so that the marking element can be projected or retracted with respect to the said barrel by the selected manual rotation of said coil.

2. A writing instrument as in claim 1 in which each said bifurcated element has a camming face adapted to guide a marking element between the bifurcations and toward the stop member.

3. A writing instrument as in claim 1 in which the marking element positioning means is substantially symmetrical with respect to a plane passing through the stop member at right angles to the longitudinal axis of the writing instrument.

4. A writing instrument as in claim 1 wherein the element forming the spiral coil is of rounded form in cross section.

5. A writing instrument as in claim 1 in which the laterally yieldable gripping elements in the forwardly and rearwardly facing portions of the marking element positioning means have different spacing whereby they are adapted to receive marking elements of different sizes, the gripping element having the desired spacing being assembled facing toward the forward end of the barrel to engage the desired size marking element.

6. A writing instrument as in claim 1 wherein said bifurcated element has a camming face adapted to guide a marking element between the bifurcations and toward said stop member.

7. A writing instrument as defined in claim 1 and further characterized by a washer of a plastic material located within said bore substantially adjacent the forward writing end of the barrel, said washer being adapted for light frictional engagement with a marking element to prevent a broken segment from falling out the forward end of said barrel.

8. A writing instrument adapted to contain a marking element therein comprising a barrel having internal wall portions that form a main internal bore, a spiral coil positioned within said bore and adapted for manual rotation therein and an integral marking element positioning means operably positioned within said bore in captive spaced relation between an internal portion of said barrel and the external configuration of said coil and restrained for longitudinal linear movement within said bore in response to rotation of said coil, said marking element positioning means comprising forwardly and rearwardly facing portions and a stop member positioned between said portions and adapted to engage in abutting relation a marking element and arrest the rearward movement thereof, at least one of said forwardly and rearwardly facing portions having a bifurcated element having elastic and laterally yieldable elements disposed within said coil and adapted to engage and frictionally grip the periphery of a marking element inserted between the bifurcation so that the marking element can be projected from and retracted within said barrel respectively by manual rotation of said coil.

9. A writing instrument adapted to contain a marking element therein comprising a barrel having internal wall portions that form a main internal bore, a spiral coil positioned within said bore and adapted for manual rotation therein, and a marking element positioning means operably positioned within said bore in captive spaced relation between an internal wall portion of said barrel and the external configuration of said coil and restrained for longitudinal linear movement within said bore in response to rotation of said coil, said marking element positioning means comprising a unitary member having positioned within said coil a forwardly facing portion and a stop member positioned rearwardly of said forward facing portion and adapted to engage in abutting relation a marking element inserted into said forwardly facing portion and arrest the rearward movement thereof, said forwardly facing portion being elastic and laterally yieldable to engage and frictionally grip the periphery of a marking element inserted therein so that the marking element can be selectively propelled from and retracted within the forward end of said barrel by the rotation of said coil, said unitary member thereby providing the dual function of first a propelling means by said stop member for moving the marking element forwardly and exteriorly of the barrel for writing and second a clutch means by said forwardly facing portion for moving the marking element rearwardly within the barrel and further preventing the rotation of the marking element within the barrel during writing and also preventing the marking element from dropping free of the barrel by gravity when pointed downwardly.

10. A writing instrument as defined in claim 1 and further characterized by a driving member rotatably connected to said barrel and having a forwardly facing sleeve portion and a rearwardly facing sleeve portion, said forwardly facing sleeve portion having an inwardly facing annular groove formed therein.

11. A writing instrument as defined in claim 10 and further characterized by an eraser member positioned within the rearwardly facing sleeve portion of said driving member.

12. A writing instrument as defined in claim 10 and further characterized by a clip member integrally formed on said driving member.

13. A writing instrument as defined in claim 10 and further characterized in that the rear end of said barrel is of a reduced diameter having an outwardly facing annular ring formed thereabout so that rear end of said barrel is rotatably joined with said driving member by means of said outwardly facing annular ring on said barrel being positioned in said inwardly facing annular groove of said forward facing sleeve portion.

14. A writing instrument as defined in claim 13 and further characterized by a forwardly facing internal tubular section disposed within said forwardly facing sleeve portion and the forward portion thereof receiving therein in frictional engagement said spiral coil so that rotation of the driving member effects rotation of the spiral coil.

* * * * *